United States Patent [19]

Gartner

[11] 4,008,698

[45] Feb. 22, 1977

[54] HIGH ENERGY ADAPTIVE IGNITION SYSTEM

[75] Inventor: Todd Henry Gartner, Elmhurst, Ill.

[73] Assignee: Motorola, Inc., Schaumburg, Ill.

[22] Filed: Aug. 28, 1975

[21] Appl. No.: 608,435

[52] U.S. Cl. ..... 123/117 R; 123/148 E

[51] Int. Cl.[2] ..... F02P 1/00

[58] Field of Search ..... 123/148 E, 117 R, 146.5 A

[56] References Cited

UNITED STATES PATENTS

| | | | |
|---|---|---|---|
| 3,377,998 | 4/1968 | Adams et al. | 123/148 E |
| 3,575,154 | 4/1971 | Taylor | 123/148 E |
| 3,605,713 | 4/1971 | LeMasters | 123/148 E |
| 3,916,855 | 11/1975 | Fauser et al. | 123/148 E |
| 3,938,490 | 2/1976 | Snyder et al. | 123/148 E |

*Primary Examiner*—C. J. Husar
*Assistant Examiner*—Paul Devinsky
*Attorney, Agent, or Firm*—Donald J. Lisa; James W. Gillman

[57] ABSTRACT

An improved ignition system uses feedback techniques to maintain a constant high energy ignition spark level over the normal range of engine RPM. The feedback automatically compensates for environmental and aging effects such as increased ignition coil resistance and decreased battery voltage.

A voltage controlled monostable multivibrator produces pulses determining the "on" time of an electronic switch which is in series with the coil. Current through the coil is sensed by a generator which feeds back an appropriate signal to control the monostable whereby a constant dwell time is maintained. At very high engine RPM a second feedback source servo-controls the system to a constant dwell angle condition. A constant dwell angle is also established at cranking speeds by a second pulse generator in parallel with the first.

8 Claims, 3 Drawing Figures

HIGH ENERGY ADAPTIVE IGNITION SYSTEM

BACKGROUND OF THE INVENTION

This invention relates to ignition systems for internal combustion engines and, more particularly, to all electronic, compensating, and high energy improvements of the same.

Conventional vehicular ignition systems, such as, for example, of the Kettering type, generate high voltage sparks suitable for firing the engine's combustion chambers at predetermined engine angular positions. Such ignition systems of the inductive storage type commonly comprise a pair of mechanical breaker points series connected to the primary of an autoformer, otherwise known as the ignition coil. The breaker points are closed for a predetermined period, commonly referred to as dwell time, whereby energy is built up in the primary of the coil. At a predetermined engine angular position the points open, which, via the turns ratio of the coil, produces a high voltage spark at the coil secondary output.

A fundamental problem with such inductive storage type systems is that spark energy decreases with increasing engine RPM. The breaker points open and close at a constant percent duty cycle rate, thereby effecting a constant dwell angle ignition control. With increasing engine RPM the period of the engine cycle decreases whereby the time required to traverse the constant dwell angle decreases. The resultant shorter dwell times leads to an increased probability of engine misfiring.

The advent of fully electronic ignition systems has resulted in considerable improvements over conventional breaker point ignitions. Specifically, the short lived and unreliable breaker points have been replaced with optical or reluctance type sensors which seldom require maintenance. Further, the electronic systems allow the circuit designer to electrically control the dwell period. Thus, a family of "high energy" electronic ignition systems has evolved. Nonetheless, significant problems with such systems still arise. For example, many electronic ignitions which employ reluctance type pickups sense engine RPM by the amplitude of the induced sensor signal. While the sensor signal amplitude is a fuction of engine RPM, it is also a function of variables such as the gap between the sensor and rotating sensing element, as well as the inductance of the sensor pickup coil. Undesired changes in either of the above variables necessarily leads to an error in the resultant ignition system, whereby frequent maintenance is required to avoid engine misfiring. Also, electronic systems which maintain longer dwell times can lead to wasted heat energy in the coil. During dwell time the current through the coil increases exponentially, whereby for long dwell times a considerable current is established. Since the coil has an intrinsic internal resistance a resultant $I^2R$ power is generated.

Finally, a fundamental problem with all conventional ignition systems is that they are subject to environmental effects as well as aging. Fluctuations in the battery voltage, as with temperature, may significantly affect the available spark energy from the ignition.

OBJECTS OF THE INVENTION

It is an object of the invention, therefore, to provide an improved electronic ignition system of the high energy type which is adaptable to compensate for environmental and aging effects.

It is a further object of the invention to provide an ignition system of the above described type whose characteristics are independent of the amplitude of the engine RPM sensor pickup.

Briefly, according to the invention, the primary winding of an ignition coil is electrically connected in series between a bias supply, i.e. the battery, and an electronic switch. The switch, preferably a power transistor, may be controlled to a conductive or non-conductive state in response to signals received at the switch control terminal, e.g. the base of the transistor. The periodic output of a reluctance pickup which is synchronous to the engine cycle is fed to a voltage variable monostable multivibrator, which, in turn, couples a pulse to the control terminal of the switch. The pulse has a predetermined time duration defined by pulse leading and trailing edges. The trailing edge occurs synchronously to the engine position corresponding to the time of ignition firing, and is suitable to render the switch in a nonconductive state. The leading edge of the pulse is predeterminedly controlled relative to the trailing edge by two inputs to the multivibrator. To the first monostable input is applied the time integral of a current limit pulse. The current limit pulse is of fixed amplitude and has a variable width representative of the time during each engine cycle that the coil primary carries a minimum predetermined current, i.e. a given minimum energy level. This pulse is generated by a comparator whose first input connects to a reference potential and whose second input connects to a current sense resistor in series with the coil.

The second monostable input is the time integral of a pulse whose width is representative of the time during each engine cycle that the coil is in a non-conductive state. This signal may be derived directly from the control terminal of the electronic switch.

In response to the current limit "feed back" signal the resulting monostable output pulse is of constant width, and thus the ignition coil produces a constant energy level, over the normal range of engine RPM. At extremely high RPM processing of the coil "off time"-feed back signal returns the ignition to a constant dwell angle type at extremely higher RPM. Further, an additional generator, which runs parallel to the monostable multivibrator, controls the electronic switch at engine cranking RPM, similarly effecting a constant dwell angle.

Since the feedback signals servo control the ignition to maintain a constant dwell time at a given coil current, component variables, such as battery voltage and coil resistance are automatically accounted for. Moreover, the current limit feedback may be used to current limit the coil whereby power losses are minimized. Finally, since engine RPM is detected independently of the magnitude of the sensor input signal a non-critical, inexpensive sensor may be employed.

DETAILED DESCRIPTION OF THE PREFERRED EMBODIMENT OF THE INVENTION

Figure 1:
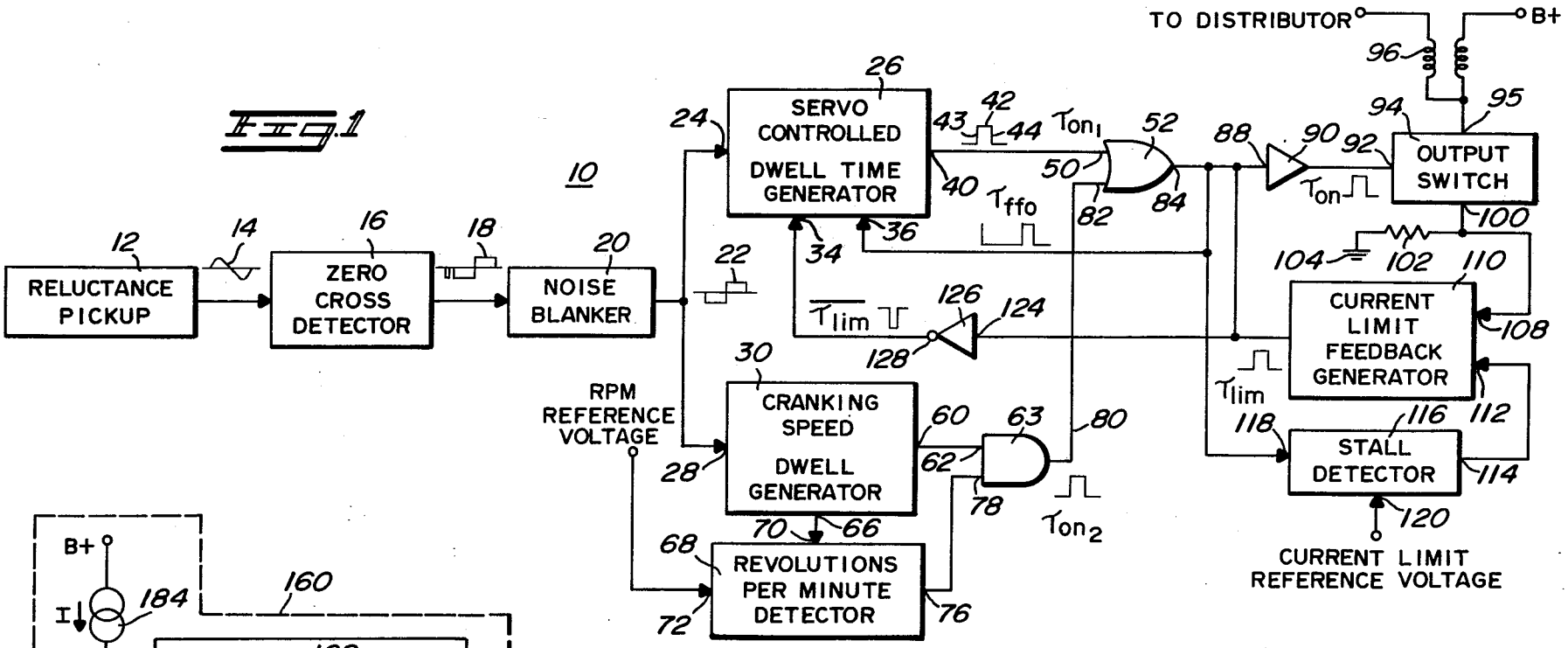
FIG. 1 is a generalized block diagram illustrating the preferred embodiment of the invention.

Reference is made to FIG. 1, wherein is shown a block diagram of an ignition system 10 according to the invention. A reluctance pickup 12 produces an output periodic wave (indicated at 14) whose zero cross time is synchronous with the desired ignition firing time of the engine. The pickup 12 output feeds to a zero cross detector 16 which squares the input signal producing an output indicated at 18. A noise blanker 20 further processes the output from the zero cross detector 16 removing any noise pulses which might occur during engine firing, and producing a resultant output waveform indicated at 22. Since the system's operation is dependent upon only the zero cross time of the sensor waveform and not its amplitude special linear processing circuitry is not required.

The blanker 20 output feeds to an input 24 of a servo controlled dwell time generator 26, and to an input 28 of a cranking speed dwell generator 30. The servo controlled dwell time generator 26, which is more fully described with reference to FIG. 2, has a current limit generator input 34 and a coil "off time" generator input 36. The controlled dwell time generator 26 produces at its output 40 a pulse (indicated at 42) having a predetermined width defined by a leading edge 43 and a trailing edge 44. This pulse feeds to the first input 50 of a two input NOR gate 52.

The cranking speed dwell generator 30 has a first output 60 coupling to the first input 62 of a two input AND gate 63. A second cranking dwell generator output 66 couples to an RPM detector 68 at the first RPM detector input 70. An RPM reference voltage is applied to the second RPM detector input 72. Circuitry within the RPM detectors 68 compares the period of periodic waveforms from the cranking dwell generator output 66 to the RPM reference voltage, producing a resultant output at RPM detector output 76 which feeds to the second input 78 of a two input AND gate 63. The AND gate output 80 feeds to the second input 82 of NOR gate 52.

The output 84 of NOR gate 52 feeds to the input 88 of a buffer amplifier 90 whose output couples to the control terminal input 92 of an output electronic switch 94. The switch has a first terminal 95 which series connects through an ignition coil 96 to a source of bias voltage. A second switch terminal 100 series connects through a current sense resistor 102 to ground, or reference potential, 104.

Voltage developed across sensing resistor 102 is coupled to the first input 108 of a current limit feedback generator 110. Feedback generator 110 has a second input 112 fed from the output 114 of a stall detector 116. The stall detector has a first input 118 which couples to the output of NOR gate 52, and a second input 120 which connects to a current limit reference voltage. In response to signals at its inputs 108, 112 the current limit feedback generator 110 produces an output pulse which is fed first to the input 88 of buffer 90 and second to the input 124 of an inverter 126 whose output 128 feeds to the current limit input terminal 34 of the servo controlled generator 26. Finally, the output of NOR gate 52 connects to the coil off time generator input 36 of dwell time generator 26.

In operation, the periodic output signal from the reluctance pickup 12, which is synchronous to the engine cycle and whose zero crossing point from a positive to a negative voltage corresponds to the precise desired time of engine firing, is wave shaped through zero cross detector 16 and noise blanker 20. The resultant square waveform is fed to the servo controlled dwell time generator 26 which controls dwell for engine RPM above a predetermined minimum, which, in the preferred embodiment, is 600 RPM. This servo dwell generator 26 has two feedback inputs, the coil "off time" at input 36 and the coil "current limit time" at input 34. The off time input controls dwell in the high speed range only, i.e. 3,000 to 5,000 RPM, and the current limit time controls dwell in the normal driving range, i.e. 600–3000 RPM.

Servo controlled dwell time generator 26 produces at its output 40 a pulse having a trailing edge 44 synchronous to the zero crossing of the wave shaped reluctance signal, and a leading edge 43 which is predeterminedly time spaced relative to the trailing edge responsive to the two feedback signals at inputs 34, 46. In the normal RPM range, the current limit feedback dominates, and the leading edge 43 of the output pulse 42 corresponds to a constant dwell time sufficient to achieve a 100 mJ ignition coil energy level. Since coil energy is dependent on coil current, sense resistor 102, in series with the coil 96, provides an analog voltage output to current limit feedback generator input 108 which is proportional to coil current. Feedback generator 110 compares the sense coil current with a reference signal supplied by stall detector 116 at feedback generator second input 112, producing an output pulse whose width is representative of the time during each engine cycle that the coil primary carries a minimum predetermined current. This signal is fed back to the dwell time generator current limit input 34 through inverter 126 and to the input 88 of buffer amplifier 90. To minimize excessive power loss in the coil the current limit output pulse from the feedback generator 110 biases the buffer 90 such that the current in the output switch 94, and thus coil 96, ceases to increase.

For high speed range RPM, namely 3,000–5,000 RPM, the coil off time input 36 dominates. At very high RPM there is insufficient engine cycle time available to maintain the constant dwell time necessary to achieve 100 mJ of coil energy. Therefore, the servo controlled dwell time generator 26 responds to off time pulses to achieve a fixed dwell angle whose dwell time occupies 75% of the engine cycle.

At cranking speeds, namely 30–600 RPM, the output from AND gate 63 is OR'ed with the output from the servo controlled dwell time generator 40 whereby the resultant dwell time pulse at OR gate output 84 is at a fixed dwell angle which is approximately 25% of the engine cycle time. The cranking speed dwell generator 28 constantly provides at its output 60 a pulse whose dwell equivalent duty cycle is 25% of engine cycle time. RPM detector 68 senses the duty cycle of reluctance pickup output pulses comparing a derived analog voltage thereof with an input reference voltage. Once a minimum RPM is developed, as defined by the RPM reference voltage, the RPM detector output 76 assumes a low output state whereby AND gate 63 is never satisfied and thus does not contribute to OR gate output 84. However, at cranking speeds, the RPM detector output 76 assumes a high state whereby AND gate 63 passes the cranking speed dwell generator output directly to OR gate second input 82.

Should a static engine condition exist stall detector 116, which provides at its output 114 the current limit comparison signal to feedback generator input 112, responds to shut down the system. An unchanging OR gate 52 output 84 is sensed at stall detector input 118 and results in a decreasing voltage at stall detector output 114. This results in current limit feedback generator 110 reducing the drive to buffer 90 at buffer input 88 which, in turn, renders output switch 94 to a nonconductive state.

Figure 2:
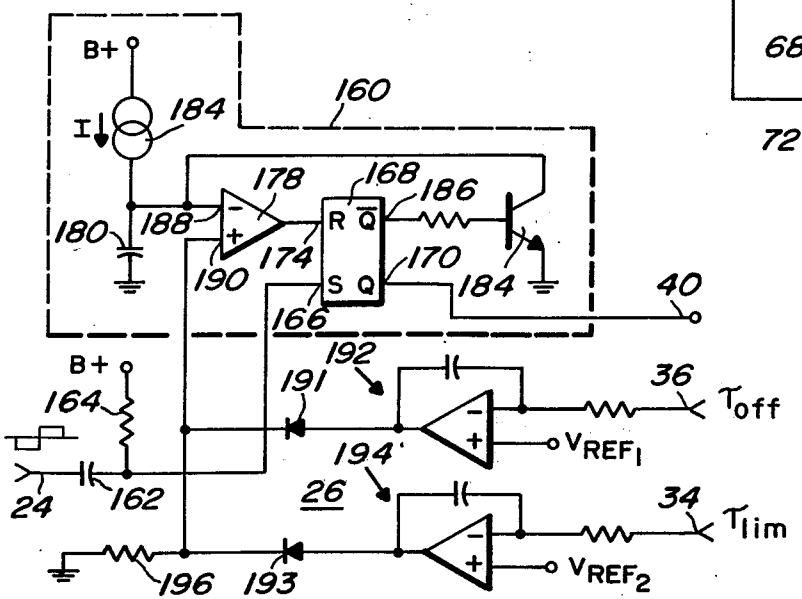
FIG. 2 is a detailed schematic of the servo controlled dwell time generator according to the invention.

The servo dwell generator 26 is more readily understood with reference to FIG. 2. Basically, servo generator 26 is comprised of a voltage controlled monostable 160 which is triggered by the negative edge of the zero cross square wave applied at generator trigger input 24. The wave shape signal is differentiated by capacitor 162 and resistor 164 and applied to the set input 166 of a set reset flip flop 168. The Q output 170 of the flip flop 168 comprises the servo dwell time generator output 40. The reset input 174 of flip flop 168 is coupled to the output of a comparator 178 whose inverting input 180 connects first to the collector of a reset transistor 184 and second to a timing capacitor 180. Capacitor 180 is current driven by current generator 184 which is connected to a bias potential. Capacitor 180 assumes a linearly increasing voltage until the $\overline{Q}$ output 186 of flip flop 168 switches to a high state. At this time reset transistor 184 is activated, whereby capacitor 180 is discharged to ground.

The non-inverting input 190 of comparator 178 couples through a first diode 191 to a first integrator 192, through a second diode 193 to a second integrator 194, and through a summing resistor 196 to ground potential. Diodes 191, 193 act as a linear two input logic OR gate whereby either the first integrator 192 output or the second integrator 194 output is supplied to the voltage control terminal of the voltage controlled monostable 160.

Each integrator 192, 194 acts as a low pass filter averaging the pulse width of input pulses to their period of occurrence (i.e. duty cycle), comparing this to a reference value $V_{ref1}$, $V_{ref2}$ respectively, and amplifying the difference. The net effect, therefore, is a nearly DC output from the diode 191, 193 OR gate which is a function of pulse duty cycle with a high gain coefficient. When the loop is closed, via the current limit time feedback pulse, for example, the system will stabilize at a value of off time that causes the duty cycle of current limit time to equal a preset reference level, such as 10%. The actual coil time constant does not enter directly and is therefore automatically compensated; this necessarily occurs because the circuit always generates an off time that leads to current limiting.

A similar action occurs with the integrator 192 low pass filter that averages the off time; this loop causing the system to stabilize at a duty cycle of off time equal to a fixed value, such as 25%. This results in the fixed dwell angle control at high RPM. Thus, it is seen that the servo action of the two feedback loops cause the multivibrator output pulse to be of a particular constant width for predetermined current limit inputs and of a particular constant duty cycle for predetermined off time inputs.

Figure 3:
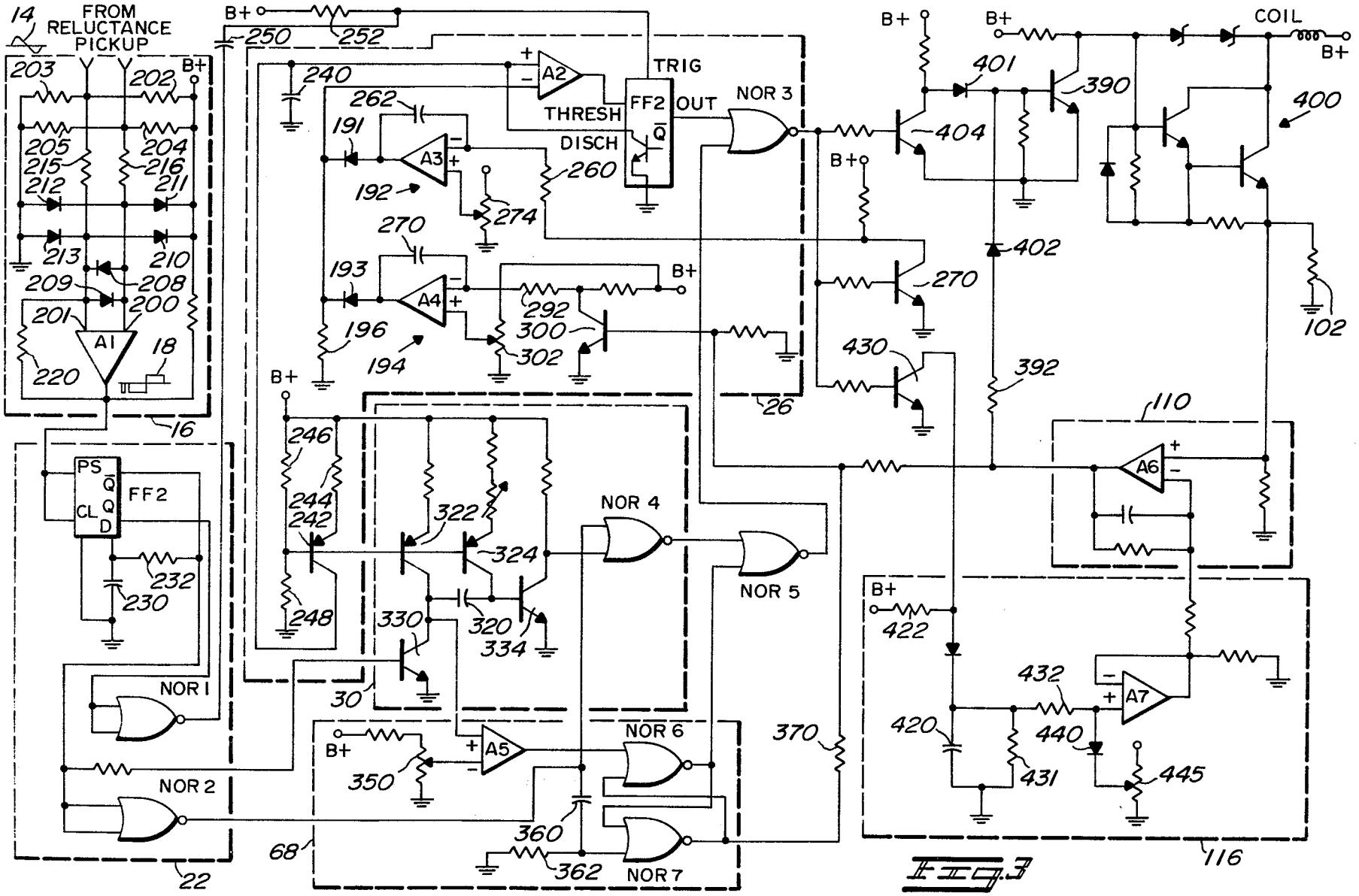
FIG. 3 is a detailed schematic diagram of the preferred embodiment.

FIG. 3 is a detailed schematic diagram of the preferred embodiment of the invention. The output signal 14 from the reluctance sensor feeds to a zero cross detector 16. The detector is a comparator A1 with hysteresis. The comparator's inverting and non-inverting inputs 200, 201 respectively are biased to one-half the B+ voltage by biasing resistors 200–205. Six clamping diodes 208–213 are used to voltage clamp input signals, and resistors 215, 216 are used to limit the current, into comparator A1. A resistor 220 provides feedback for hysteresis.

The output from the zero cross detector 16 taken from the output of comparator A1 has a waveform voltage 18 which is fed to the input of noise blanker circuitry 22. At spark time, radio frequency interference picked up at the comparator Al input can cause noise to appear on the comparator output. This is "blanked" by the use of the D type flip flop FF1. As the A1 output goes low (spark time), the Q output of flip flop 1 goes high and the $\overline{Q}$ low because of the zero at the preset input. However the voltage at capacitor 230 is at a logic 1 (since $\overline{Q}$ was previously high,) and stays high until the exponential decay of capacitor 230 reaches a logic 0. During this time a noise spike that might cause comparator A1 to go high will not change the Q, $\overline{Q}$ outputs of flip flop 1 because the clock lead would clock in a 1 at the D input. Logic gates NOR1 and NOR2 are used as buffers. At the half cycle time when comparator A1 normally goes high, the D input of flip flop 1 will be at a zero and its output will change.

Outputs from the noise blanker circuitry 22 feed to the servo controlled dwell time generator 26. The voltage controlled monostable portion of generator 26 is implemented with a comparator A2 and a set/reset flip flop, FF2. A capacitor 240 and a current source generator comprised of transistor 242 and associate resistors 244, 246, and 248 generate a reference ramp voltage. When comparator A1 goes negative (and NOR1), a differentiator comprised of a capacitor 250 and a resistor 252 triggers the second flip flop FF2 output to a high state which also open circuits the clamp transistor (which is internal to flip flop 2) connected to capacitor 240. At this point the capacitor 240 produces a ramp voltage which increases until it crosses the reference voltage at the comparator A2 negative input, at which time the A2 output goes high resetting the flip flpp 2 output low via the threshold lead. With the flip flop output low, capacitor 240 is clamped to ground comparator and the output of A2 goes low.

The integrator, or low pass filter 192 comprising an amplifier A3 and time constant components resistor 260 and capacitor 262 controls high speed dwell and averages the coil off signal provided by a transistor 270. Output gate NOR3 provides the valid coil on output, which transistor 270 inverts for proper application to the integrator 192. A voltage reference to amplifier A3 is provided by a potentiometer 274 which may be adjusted for a desired percent dwell. The second integrator, or low pass filter, 194 is comprised of an amplifier A5 along with time constant components including a capacitor 290 and a resistor 292. Integrator 194 controls dwell from idle to the high speed region. The non-current limit time $\overline{t_{lim}}$ is averaged and is available at the collector of a transistor 300. A potentiometer 302 is adjustable to set the current limit time duty cycle to a desired value. The outputs of integrators 192, 194 are "OR'ed" by a pair of diodes 191, 193 respectively. The resultant feedback signal is summed through resistor 196 and applied to the inverting input of amplifier A2.

Also processing the output of the noise blanker 22 is a cranking speed dwell generator 30, which causes a dual slope integration technique to generate a 25% dwell function. This is achieved by alternately charging and discharging a timing capacitor 320 via a pair of current sources comprising transistors 322 and 324. During the first half engine cycle a switching transistor 330 is turned off allowing current source transistor 322 to charge up the timing capacitor 320. At this time a second switching transistor 334 is biased on by current source transistor 324. During the second half of the cycle switching transistor 330 is turned on thereby grounding current source transistor 322 and causing a voltage drop at the collector of current source transistor 324 which is equal to the peak voltage at the collector of transistor 322 just prior to switching transistor 330 turn on. This turns off switching transistor 334 by back biasing its base emitter junction. Timing capacitor 320 now ramps up via current source transistor 324 at twice the rate it was charged by current source transistor 320 until the base emitter turn on voltage of switching transistor 334 is reached, which thereafter clamps the collector of transistor 324 to one diode drop. The end result is that the remaining time from the turn on of transistor 334 in the second half cycle to the end of the cycle (25% of total period) is determined by the ratios of the currents provided by first and second current source transistors 322, 324, and not by timing capacitor 320 or RPM. A desired dwell signal is represented by a low collector output of switching transistor 334 during the second half cycle. Since the collector of switching transistor 334 is also low in the first half cycle, which is undesirable, a gate NOR4 which operates via a high output of NOR2, is implemented to produce the desired signal. The true dwell signal now appears at the NOR4 output, which is further gated by the RPM detector signal described below.

The RPM detector 68 furnishes a logic 1 signal at the output of a gate NOR6 for all RPM greater than the reference RPM threshold set by a potentiometer 350. For speeds less than the set value, the NOR6 output is low after an initial time delay. The threshold level at potentiometer 350 is compared via a comparator A5 to the initial ramp generated every first half cycle at the current source transistor 322 side of timing capacitor 320. Since the ramp rate is fixed, a given threshold level corresponds to a given RPM if that threshold is exceeded in the first half cycle. If the threshold is exceeded, the comparator A5 output goes high which sets a flip flop comprised of cross coupled gates NOR6 and NOR7 to a 0 at the NOR6 output. The NOR6-7 flip flop is reset by a positive pulse at the end of the cycle via a differentiator circuit comprised of a capacitor 360 and a resistor 362. The capacitor 360/resistor 362 time constant is purposely long to prevent radio frequency interference (which occurs at this time) from changing the NOR6-7 flip flop state to a set condition. The NOR6 output is low after the initial ramp/threshold delay for speeds in the cranking range; which allows the 25% dwell signal to propagate through NOR5 to the NOR3 gate output. For speeds above the set value, the NOR6 output is always high which gates NOR5 to a low output; which propagates the flip flop 2 output through NOR3. The complementary output at NOR7 gates through a resistor 370 to force the control voltage at resistor 292 high during cranking. This prevents drift of integrator 194 when the dwell servo system is not controlling dwell.

Current limit control is achieved by negative feedback via the differential amplifier A6. Dwell current is sensed by a resistor 102 and compared to a reference voltage supplied from the stall detector 116. For voltages exceeding the reference value the A6 output goes positive to further turn on buffer transistor 390 via a series resistor 392. This causes the collector voltage on transistor 390 to drop which reduces conduction of the output Darlington pair switch 400. A pair of diodes 401, 402 prevent interaction of the transistor 404 and amplifier A6 outputs.

In normal operation, the stall detector 116 furnishes a DC level output for speeds equal or greater than 30 RPM to the current limit amplifier A6 reference input. Operation is seen as follows. A capacitor 420 is fast charged by resistor 422 to the B+ voltage during coil off time (i.e. switching transistor 430 is off); during coil on time switching transistor 430 is on and capacitor 420 slowly discharges via resistors 431, 432. For speeds equal or greater than 30 RPM capacitor 420 does not discharge appreciably, but provides a bias current to a diode 440 via resistor 432. The cathode side of diode 440 is held at a reference level by a variable resistor 445. The voltage at the resistor 445 tap plus the voltage drop of diode 440 is the current limit reference voltage, which is buffered by amplifier A7. If the engine stalls, switching transistor 430 stays on and capacitor 420 discharges to ground. As the voltage at capacitor 420 drops below the voltage determined by variable resistor 445 and the diode drop 440, diode 440 becomes back biased and the reference level decays exponentially to zero. This slow decay reduces coil current gradually and prevents an extraneous spark during stall.

In conclusion, a fully electronic ignition system has been described which includes the features of: maintaining a constant high energy output, providing a precise ignition output determined solely by the frequency of an input sensor signal and being totally immune to amplitude variations thereof, adapting to both temperature, battery voltage variation and aging effects, and minimizing power lost in the ignition coil.

While a preferred embodiment of the invention has been fully described, it should be understood that many modifications and variations thereto are possible, all of which fall within the true spirit and scope of the invention.

I claim:

1. An ignition system for an internal combustion engine comprising an ignition coil having primary and secondary windings, the secondary winding providing a high voltage spark suitable for engine firing, the primary winding series connected between a bias supply and an electronic switch, the switch operable to conductively couple or nonconductively decouple the primary to a reference terminal dependent on signals at a switch control terminal, a sensor operably coupled to the engine producing a periodic output voltage in synchronism to the engine cycle, a controlled pulse generator, having first and second inputs, synchronized to the sensor signal and coupling to the control terminal of the electronic switch, the generator providing a pulse having a leading edge suitable for activating the switch to a conductive state and a trailing edge suitable for activating the switch to a nonconductive state, the trailing edge synchronized to occur at a predetermined engine position, the leading edge predeterminedly controlled by either of said two pulse generator inputs, the first generator input being a current limit generator input which couples to means for generating a first control signal representative of the time during each engine cycle that the coil primary carries a minimum predetermined current, and the second generator input being a coil off time generator input which couples to a means for generating a second control signal representative of the time during each engine cycle that the switch and coil are in a nonconductive state.

2. The ignition system of claim 1 wherein the controlled pulse generator comprises a voltage controlled monostable multivibrator producing pulses having predetermined leading and trailing edges at an output terminal responsive to voltage control signals at multivibrator first and second input terminals, the first input terminal coupled to the sensor causing the trailing edge to occur synchronously with a predetermined engine position, the multivibrator causing the occurrence of the pulse leading edge responsive to the control signal on the second input exceeding an internally generated ramp pulse whose period is representative of the period of the engine cycle, a two input linear logic gate coupled to the multivibrator second input, the gate producing predetermined outputs dependent on given input signals, a first integrator, coupled to the first gate input, producing a predetermined linear output proportional to the width of current limit pulses received at its input, and a second integrator, coupled to the second gate input, producing a predetermined linear output proportional to the width of coil off time pulses received at its input, whereby the servo action of the integrators and gate causes the multivibrator output pulse to be of particular constant width for predetermined current limit inputs and of particular constant duty cycle for predetermined off time inputs.

3. The system of claim 2 further comprising means responsive to the period of the sensor output exceeding a predetermined minimum to override the controlled pulse generator and activate the output switch for a fixed percentage of the engine cycle.

4. The system of claim 2 wherein the current limit generator comprises a current sense resistor in series with the coil, and a comparator producing an output pulse whose width is synchronous to the time that the voltage sensed in the resistor is in a predetermined relationship to a current limit reference voltage.

5. The system of claim 4 further comprising a stall detector which senses for a static engine condition and predeterminedly controls the current limit reference voltage such that the output of the current limit generator causes the controlled pulse generator to maintain the electronic switch in a nonconductive state.

6. The system of claim 4 wherein the electronic switch has a variable conductance dependent on input control signals, and the output pulses from the current limit generator couple to the switch control terminal to predeterminedly decrease switch conductance.

7. An ignition system for an internal combustion engine comprising sensor means sensing engine rotational position and producing an output signal representative thereof, shaping circuitry means shaping the sensor signals producing a noise free output signal which has an abrupt transition at the occurence of a predetermined engine position and which has a period equal to the engine cycle period, a first generating means processing the shaped signals and producing an output pulse having a predetermined leading and trailing edge, the trailing edge synchronous to the transition of the shaped signal, the leading edge dependent on input feedback signals, the first generator maintaining a fixed time relationship between the leading and trailing edge for a first condition of input signals, and maintaining a fixed ratio of leading to trailing edge time to total cycle time for a second condition of input signals, a second generating means processing the shaped signals and producing an output pulse whose trailing edge is synchronous to the transition of the shaped signal and whose time duration is a predeterminedly fixed percentage of the period of the shaped signal, means selectively passing the first generator pulse at engine RPM above cranking and the second generator pulse at cranking RPM, means coupling the selected signal both to one feedback input of the first generator and to the control terminal of an electronic switch, the switch having a low resistance between its first and second terminals in response to a received pulse at the control terminal, ignition coil means series connected between a source of bias voltage and the first switch terminal, current sensing means coupling the second switch terminal to a reference potential, and providing a coil current level output, means monitoring the output of the current sensor and providing a feedback input to the first generator in response to the coil current exceeding a predetermined minimum.

8. The system of claim 7 further comprising means detecting the condition of engine stall and inhibiting ignition operation in response to the detection thereof.

* * * * *